US005831499A

United States Patent [19]

Batteux et al.

[11] Patent Number: 5,831,499

[45] Date of Patent: Nov. 3, 1998

[54] SELECTIVE TRIP UNIT FOR A MULTIPOLE CIRCUIT BREAKER

[75] Inventors: Pierre Batteux, St. Pierre de Mesage; Olivier Dujeu; Serge Terpend, both of Grenoble, all of France

[73] Assignee: Schneider Electric SA, France

[21] Appl. No.: 968,017

[22] Filed: Nov. 12, 1997

[30] Foreign Application Priority Data

Dec. 13, 1996 [FR] France ..... 96 15607

[51] Int. Cl.[6] ..... H01H 75/00

[52] U.S. Cl. ..... 335/9; 335/35; 335/41; 335/172

[58] Field of Search ..... 335/8–10, 35, 335/38, 39, 40, 41, 42, 167–176

[56] References Cited

U.S. PATENT DOCUMENTS

| | | | |
|---|---|---|---|
| 3,278,708 | 10/1966 | Casey et al. | 335/41 |
| 3,384,845 | 5/1968 | Johnson et al. . | |
| 3,950,714 | 4/1976 | Mrenna et al. | 335/35 |
| 5,225,800 | 7/1993 | Pannenborg et al. | 335/35 |
| 5,469,121 | 11/1995 | Payet-Burin | 335/16 |
| 5,686,709 | 11/1997 | Casagrande et al. | 335/8 |

FOREIGN PATENT DOCUMENTS

| | | |
|---|---|---|
| 699839 | 12/1940 | Germany . |
| 1119393 | 12/1961 | Germany . |
| 1196279 | 7/1965 | Germany . |

*Primary Examiner*—Lincoln Donovan
*Attorney, Agent, or Firm*—Parkhurst & Wendel, L.L.P.

[57] ABSTRACT

A selective magnetic trip unit comprises a fixed magnetic armature located facing a movable magnetic armature and a damping device with a blade mounted on the movable magnetic armature. The damping device is designed to be in an inactive state up to an intermediate non-tripping position when the movable magnetic armature is attracted by polar parts of the fixed magnetic armature during a first travel, switching to the active state resulting from a deformation of the damping device during a second travel of the movable armature between the intermediate position and the final attraction position causing tripping of the circuit breaker.

10 Claims, 6 Drawing Sheets

SELECTIVE TRIP UNIT FOR A MULTIPOLE CIRCUIT BREAKER

BACKGROUND OF THE INVENTION

The invention relates to a trip unit for a multipole electrical circuit breaker comprising a selective magnetic trip unit per pole, said trip unit comprising:

- a U-shaped fixed magnetic armature located facing a movable magnetic armature with an air gap arranged between the two,
- a conductor associated to the fixed magnetic armature, through which conductor the current of the corresponding poles flows,
- an elastic part biasing the movable magnetic armature to a separated rest position corresponding to the maximum air gap,
- and time delay means cooperating with the movable magnetic armature to perform chronometric selectivity of protection.

Time delay means suitable for chronometric selectivity of protection are generally formed by inertia devices making use of at least one counterweight. According to a known device, the counterweight is fitted on an operating lever articulated on a spindle different from that of the movable magnetic armature. Besides the problem of inertia of moving parts, the fitting and adjusting operations of such a device remain complicated.

SUMMARY OF THE INVENTION

The object of the invention is to achieve a selective trip unit of simplified construction, and with compact overall dimensions.

The trip unit according to the invention is characterized in that the time delay means comprise a damping device fitted on the movable magnetic armature and designed to be in an inactive state up to an intermediate non-tripping position when the movable magnetic armature is attracted by polar parts of the fixed magnetic armature during a first travel, switching to the active state resulting from a deformation of the damping device during a second travel of the movable armature between the intermediate position and the final attraction position causing tripping of the circuit breaker.

According to a preferred embodiment, the movable magnetic armature is mounted with pivoting on a bracket fixed to a conductor, and the damping device comprises a metallic blade of small thickness arranged in a gap between the movable armature and said bracket.

The blade of the damping device comprises a base clipped onto a protuberance of the bracket and an upper part cooperating with a drive part of the movable magnetic armature.

According to one feature of the invention, the fixed bracket is equipped with lateral lugs arranged to define the rest position of the movable magnetic armature and said gap for housing the blade. The elastic return part of the movable armature is advantageously formed by a compression spring arranged on the side opposite the gap between the base of the bracket and an edge of the armature.

Assembly of the selective magnetic trip unit is particularly simplified, since the bracket, the blade of the damping device, the movable magnetic armature, and the compression spring constitute a pre-assembled sub-assembly fixed by a screw onto the conductor.

BRIEF DESCRIPTION OF THE DRAWINGS

Other advantages and features will be described more clearly in the following description of different embodiments of the invention given as non-restrictive examples only and represented in the accompanying drawings in which.

DETAILED DESCRIPTION OF THE PREFERRED EMBODIMENT

Figure 1:
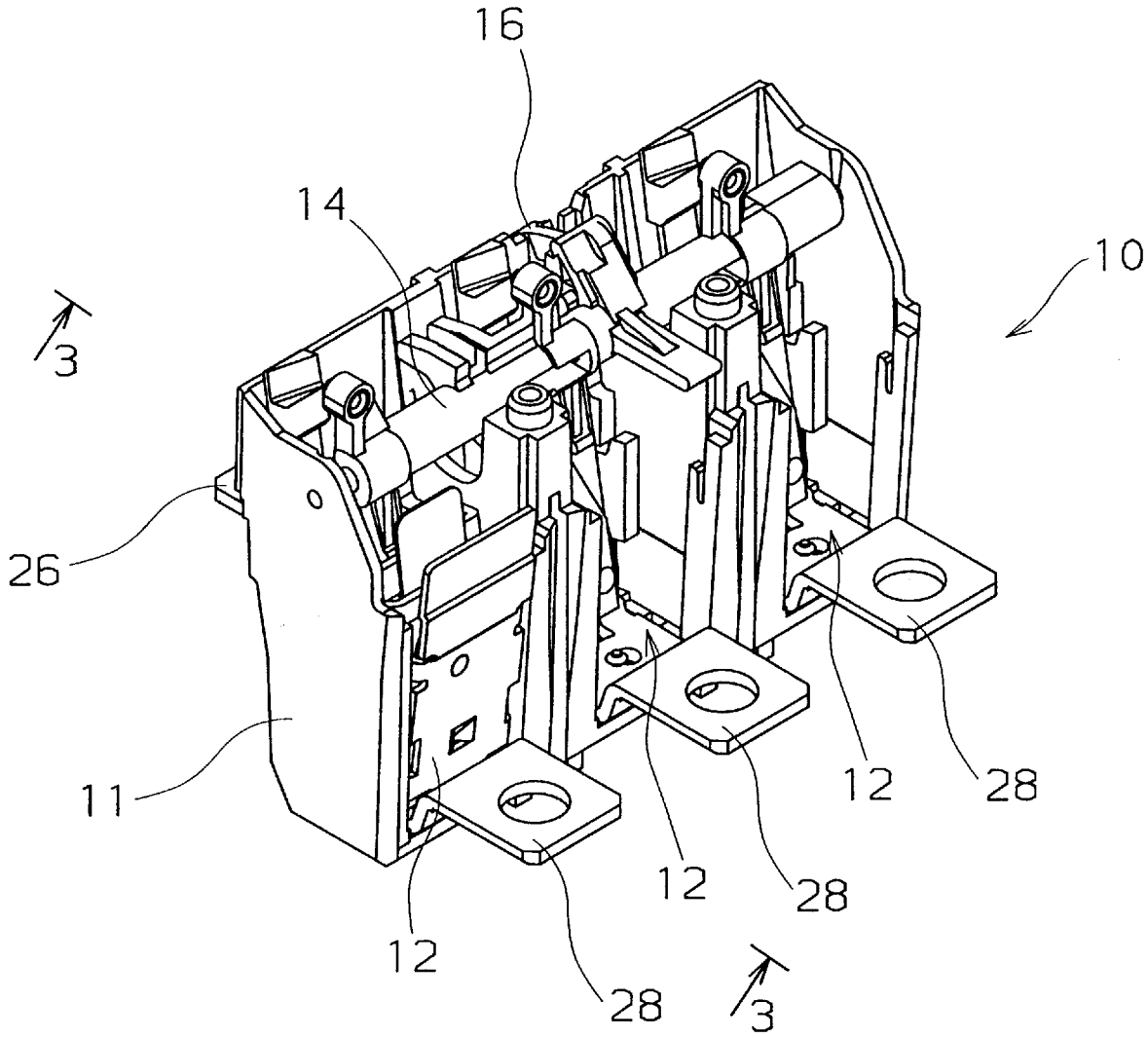
FIG. 1 is a schematic perspective view of the trip unit according to the invention, a single selective magnetic trip device being represented on the left-hand pole.
Figure 2:
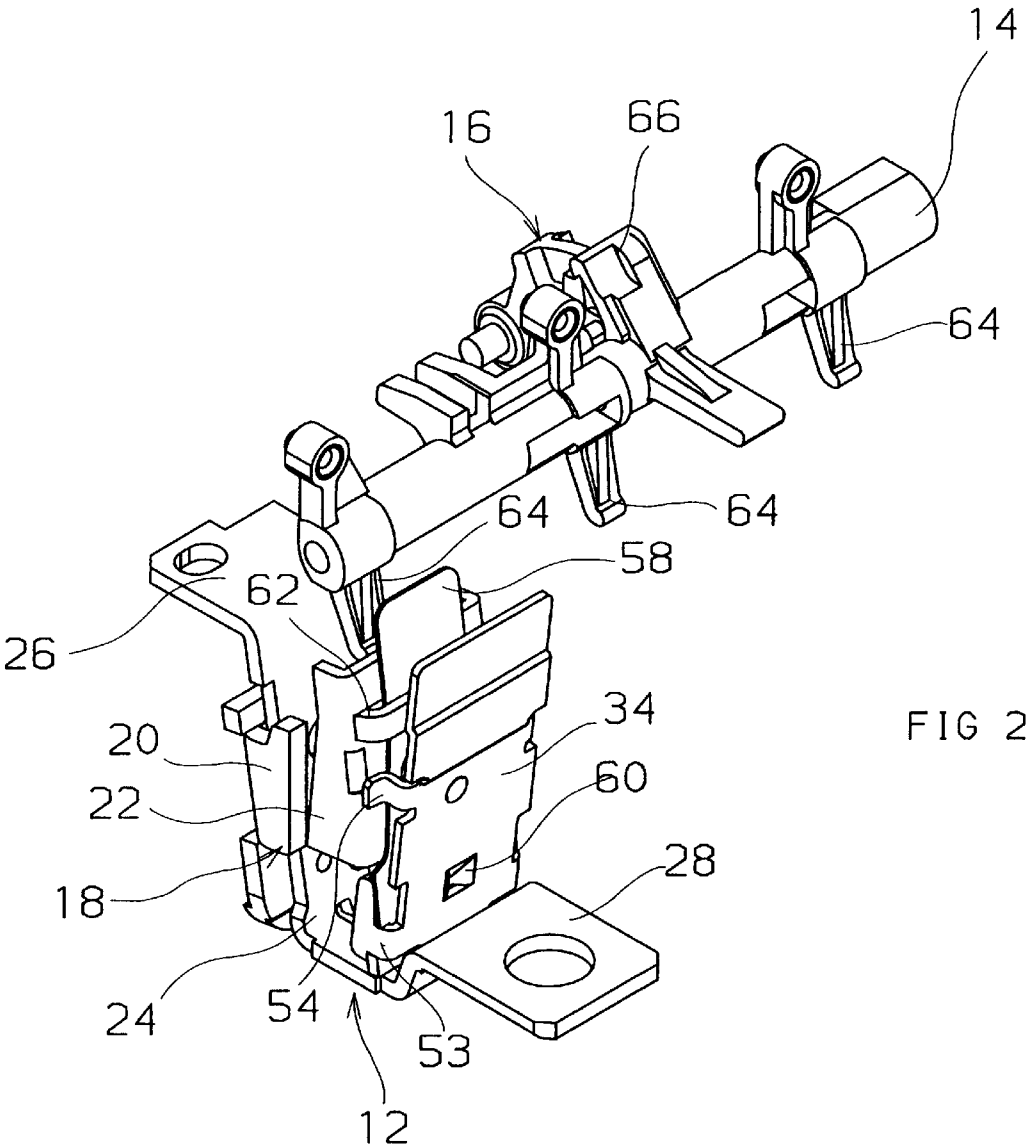
FIG. 2 shows the trip device of FIG. 1 on an enlarged scale after the insulating case has been removed.

In FIG. 1, a trip unit 10 for a multipole electrical circuit breaker (not represented) comprises an insulating case 11 housing monitoring means 12 for monitoring the current passing through each pole and a common trip bar 14. An energy storage mechanism 16 with a striker cooperates with the trip bar 14 to bring about unlocking of the circuit breaker operating mechanism in the event of a short-circuit current being detected by the trip unit 10. The trip bar 14 is mounted with limited rotation in bearings of the case 11 and is movable between a loaded position enabling the circuit breaker to be closed and a tripped position causing automatic opening of the circuit breaker contacts after the energy storage mechanism 16 has been released.

With reference to FIGS. 2 to 8, the monitoring means of each pole comprise a selective magnetic trip device 18 composed of a U-shaped fixed magnetic armature 20 arranged facing a movable magnetic armature 22 which is also U-shaped. There passes through the fixed magnetic armature 20 a conductor 24 in the form of a strip in which the current to be monitored flows. The conductor 24 comprises a pair of connecting terminal strips 26, 28 at its opposite ends and an intermediate part folded into a V so as to form an obtuse angle. The horizontal branch 24*a* of the conductor 24 is fixed by a screw 30 to the base of the insulating case 11 whereas the other inclined branch 24*b* is applied against the back and inside the fixed magnetic armature 20.

The current flow in the conductor 24 creates an electromagnetic field in the air gap arranged between the fixed armature 20 and the movable armature 22 and tends to attract the latter against the polar faces of the fixed armature 20 when the current intensity exceeds a preset tripping threshold. The conductor 24 also acts as heater for a bimetal strip (not represented) of a thermal trip device which is not part of the present invention.

The movable magnetic armature 22 is mounted with limited pivoting on the base part 32 of a fixed metallic bracket 34 which is securedly affixed to the branch 24*a* of the conductor 24 by the screw 30. A compression spring 36 is inserted between the base part 32 and an edge 38 of the movable magnetic armature 22 and biases the latter to a separated rest position in such a way as to achieve a maximum air gap 40 between the movable armature 22 and the polar faces of the fixed armature 20.

The movable armature 22 comprises two parallel legs 42, 44 (see FIG. 7) equipped at their bottom ends with two pins 46, 48 positioned in cutouts of two lateral flanges of the bracket 34 to form the pivoting spindle 53 of the movable armature 22. The bracket 34 is in addition equipped with a pair of lateral lugs 54 against which the movable armature 22 comes into engagement in the separated position so as to arrange a gap 56 (FIGS. 3 and 6) for housing a damping device 58.

The damping device 58 comprises a metal blade of small thickness whose base is clipped onto a protuberance 60 of the bracket 34, whereas the upper part of the blade passes with clearance through a band 62 of the movable armature 22. The base of the blade presents a width slightly greater than the transverse distance separating the flanges 50, 52 of the bracket 34. The movable armature 22, spring 36, and blade 58 are mounted on the bracket 34 so as to constitute a pre-assembled sub-assembly (FIG. 6) ready to be incorporated in the case 11.

The trip bar 14 is situated above the selective magnetic trip devices 18 of the three poles and comprises actuating levers 64 designed to be driven individually by the movable magnetic armature 22 of each trip device when this movable armature is moved by magnetic attraction against the polar faces of the fixed armature 20. A latching lever 66 also equips the trip bar 14 to lock or release the energy storage mechanism 16 respectively in the loaded position and in the tripped position.

Figure 3:
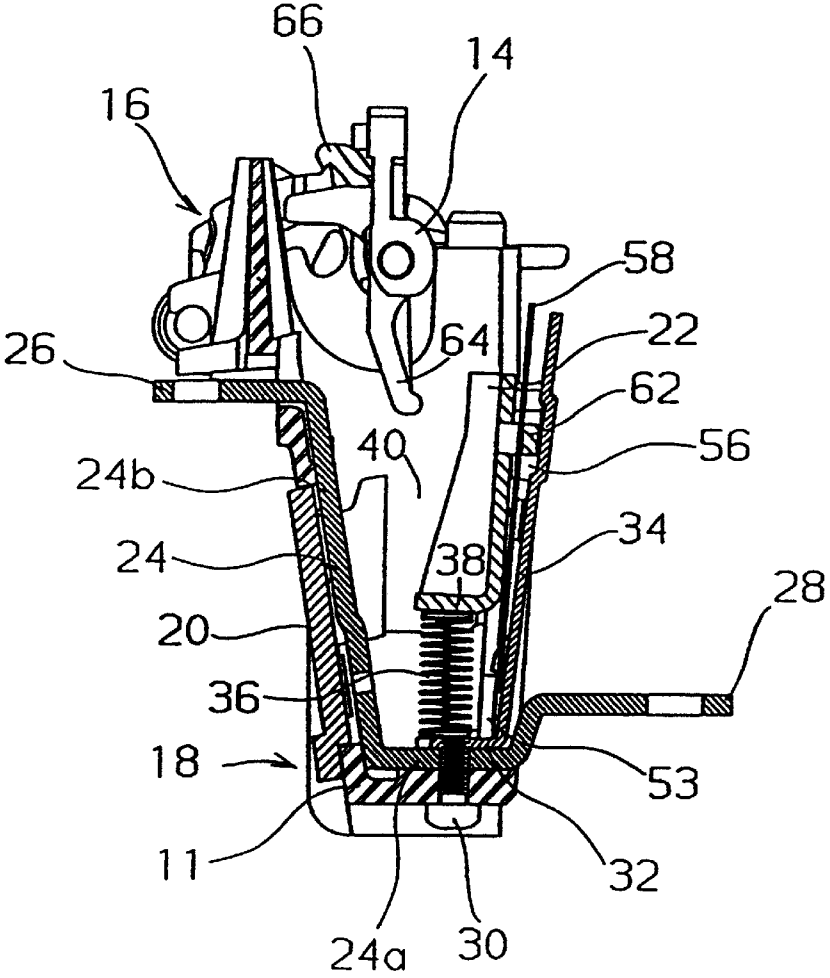
FIG. 3 is a cross-sectional view along the line 3—3 of FIG. 1, the movable magnetic armature being in the separated rest position.

Operation of the selective magnetic trip device 18 of each pole is as follows: FIG. 3 shows the magnetic trip device 18 in the inactive state in the absence of any fault on the power system. The return force of the spring 36 is permanently greater than the magnetic attraction force in the air gap 40 due to the flow of the rated current in the conductor 24. The movable magnetic armature 22 is pressing against the lugs 54 of the fixed bracket 34 and the lever 64 is separated from the movable armature 22 by a preset distance. The trip bar 14 remains immobilized in the loaded position by a polarization spring (not represented) and the latching lever 66 performs locking of the energy storage mechanism 16. The compression spring 36 extends appreciably in a direction perpendicular to the horizontal branch 24*a* of the conductor 24 and the blade of the damping device 58 is located in the gap 56 in a non-deformed state and pressing against the movable magnetic armature 22.

Figure 4:
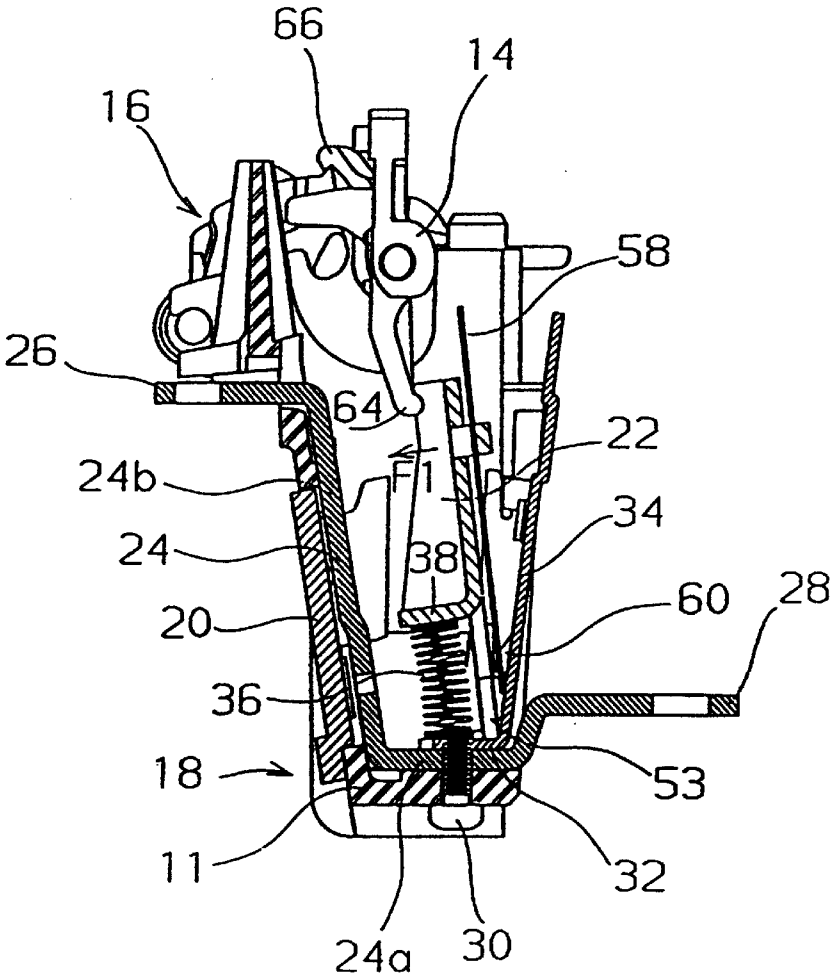
FIGS. 4 and 5 are identical views to FIG. 3 respectively in the intermediate position and in the final tripped position of the movable armature.

In the event of a short-circuit current occurring in the conductor 24, the magnetic attraction in the air gap 40 outweighs the return force of the spring 36 and causes pivoting of the movable armature 22 in the direction of the arrow F1 (FIG. 4). The spring 36 is compressed during this pivoting movement in the course of which the movable armature 22 moves the blade of the damping device 58 to an intermediate position where the blade comes up against the two flanges 50, 52 of the bracket 34. This intermediate position is reached at the end of a first travel of the movable armature 22, and the damper 58 remains in an inactive position following the absence of deformation of the blade.

Two cases of operation are then possible:

1) If the short-circuit current is cleared by a protective device against short-circuits connected lineside, the damping device with blade 58 stops the continuing movement of the movable armature 22 in the direction of the arrow F1, and the spring 36 moves the movable armature 22 back to the separated rest position illustrated in FIG. 3. The movable armature 22 does not come into engagement with the actuating lever 64 of the trip bar 14 which remains immobile in the loaded position.

Figure 5:
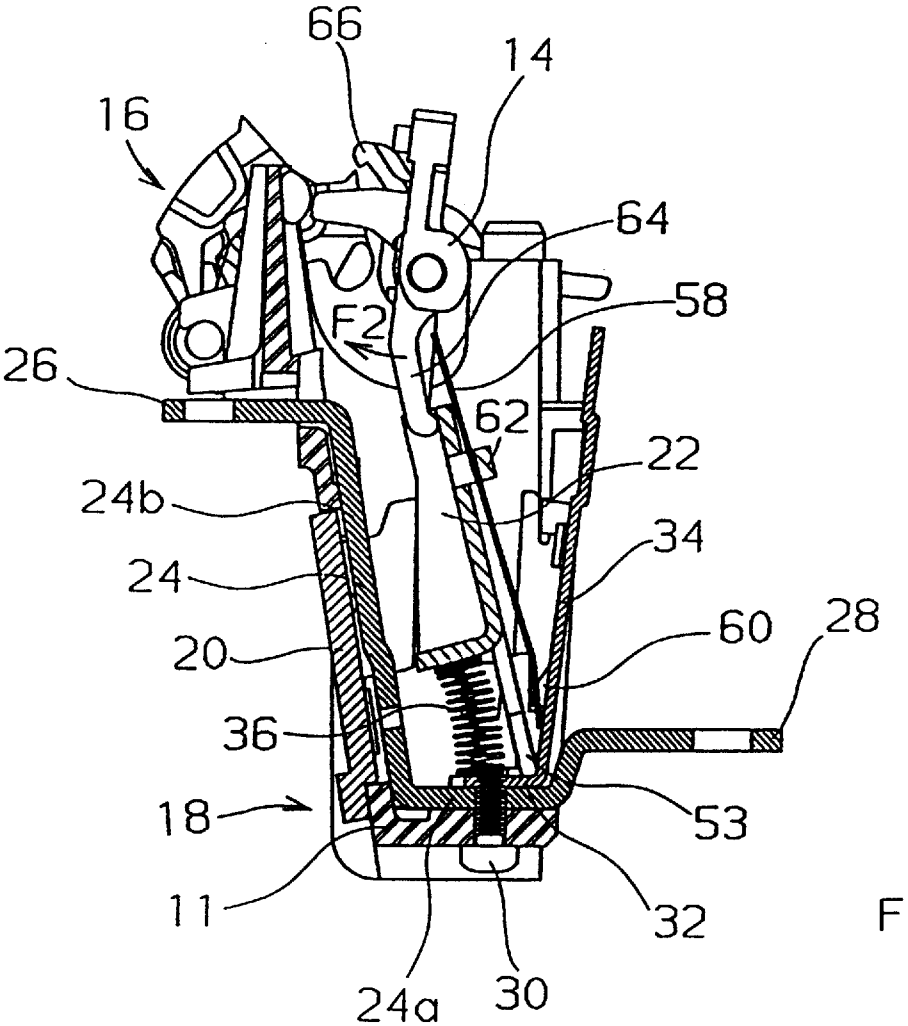
Figure 8:
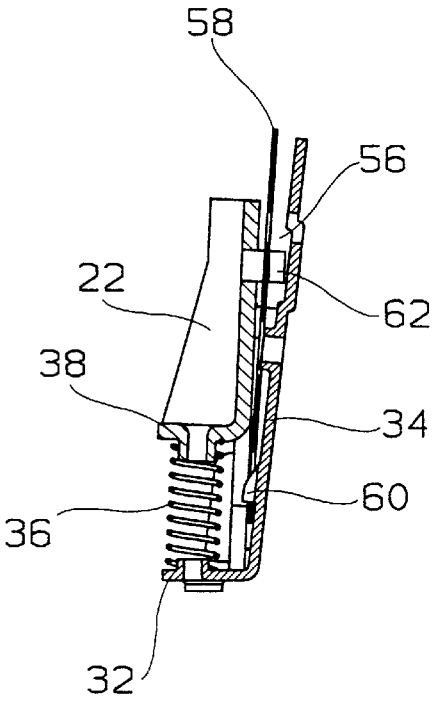
FIG. 8 is a cross-sectional view along the line 8—8 of FIG. 7.
Figure 7:
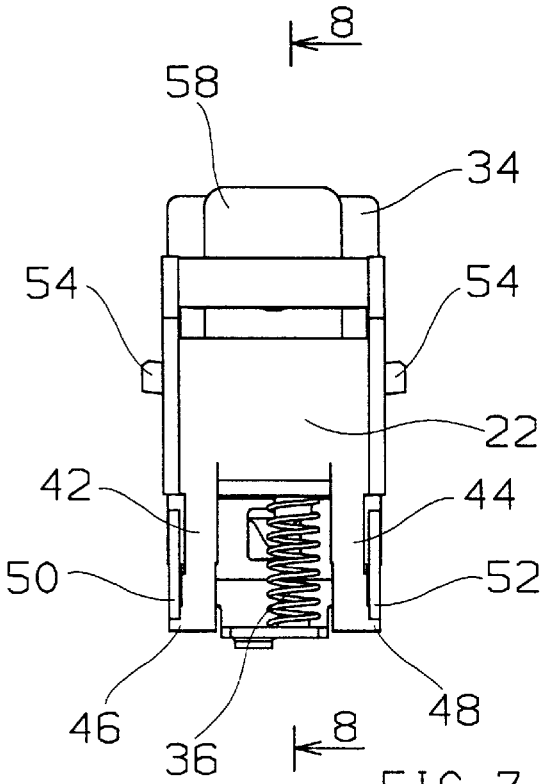
FIG. 7 is an elevational view of FIG. 6.
Figure 6:
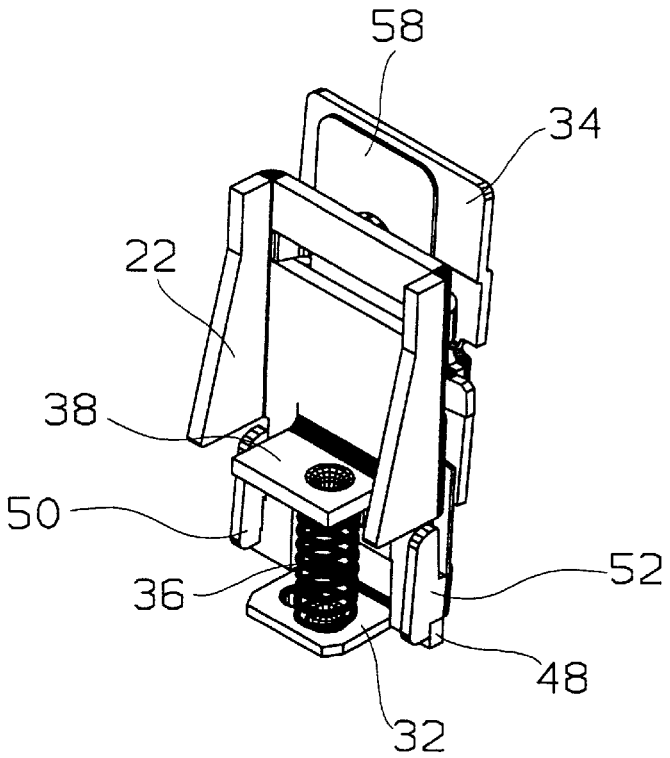
FIG. 6 is a perspective view of the pre-assembled sub-assembly comprising the bracket, movable armature, damping device blade, and return spring.

2) If the short-circuit current persists, the magnetic attraction force in the air gap 40 causes continuing pivoting of the movable armature 22 up to a final position pressing against the polar faces of the fixed armature 20 (FIG. 5). The blade of the damper 58 is deformed elastically during this second travel of the armature 22 between the intermediate position and the final position, and enables rotation of the trip bar 14 to take place in the direction of the arrow F2 to the tripped position. The latching lever 66 releases the energy storage mechanism 16 with striker for opening of the circuit breaker.

In the first case, the damping device blade 58 acts as a brake preventing movement of the movable armature 22 beyond the intermediate position. Tripping of the downline circuit breaker thus keeps the upline circuit breaker closed, the upline circuit breaker being the one associated to the selective magnetic trip device 18. Movement of the movable armature 22 from the rest position to the intermediate position takes place as soon as the current exceeds a threshold corresponding to the calibration of the spring 36.

In the second case, the deformation of the damping device blade 58 generates a time delay before effective tripping of the circuit breaker associated to the selective magnetic trip device 18. This time delay by damping depends on the intensity and duration of the short-circuit current and enables total selectivity of protection to be achieved.

Figure 9:
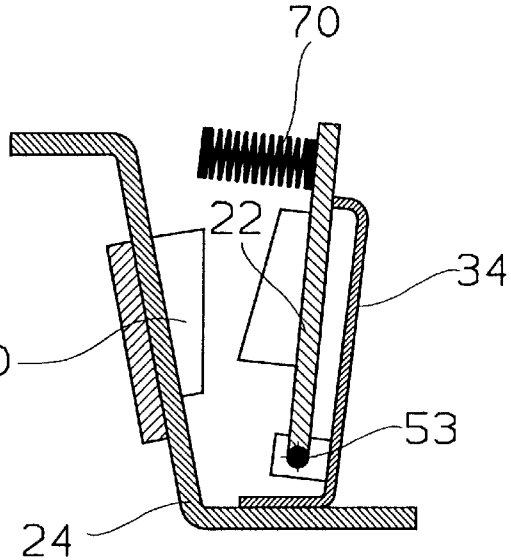
FIGS. 9 and 10 are schematic views of an alternative embodiment, respectively in the rest position and in the intermediate position of the movable armature.
Figure 10:
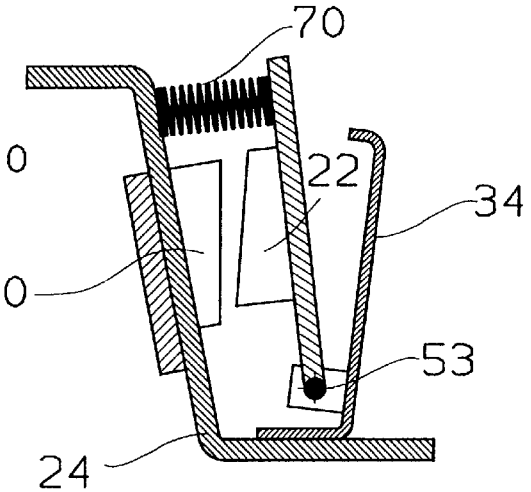

It is clear that the blade of the damping device 58 of FIGS. 2 to 8 can be replaced by equivalent damping means. In FIGS. 9 and 10, a compression spring 70 is securedly affixed to the upper end of the movable magnetic armature 22 in such a way as to press against the stop formed by the conductor 24 when the movable armature 22 is in the intermediate position. Tripping is possible when the movable armature 22 is attracted against the polar faces of the fixed armature 20, and after compression of the spring 70.

Figure 11:
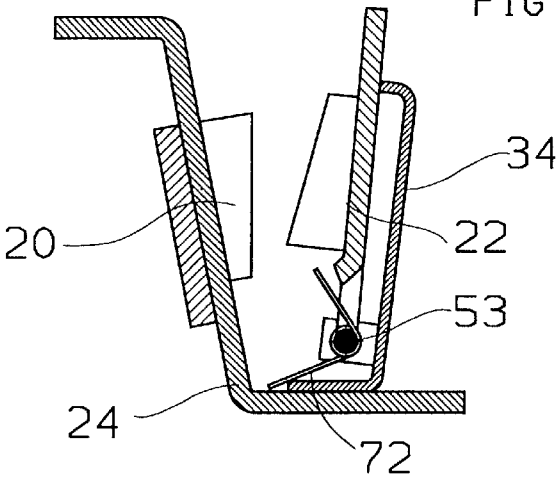
FIGS. 11 and 12 are schematic views of an alternative embodiment, respectively in the rest position and in the intermediate position of the movable armature.
Figure 12:
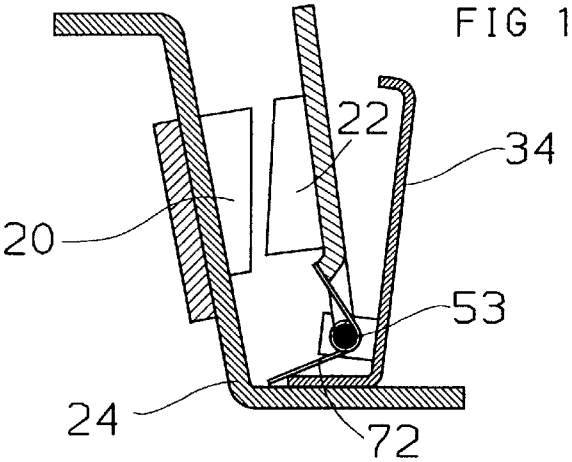

In the alternative embodiment of FIGS. 11 and 12, the damper is formed by a torsion spring 72 mounted on the pivoting spindle 53 of the movable magnetic armature 22.

The spring 72 remains inactive up to the intermediate position of the movable armature 22 and is then tensed when continuing movement takes place to the final attraction position.

We claim:

1. A trip unit for a multipole electrical circuit breaker comprising a selective magnetic trip unit per pole, said trip unit comprising:

a U-shaped fixed magnetic armature located facing a movable magnetic armature with an air gap arranged between the two, a conductor associated to the fixed magnetic armature, through which conductor the current of the corresponding poles flows, an elastic part biasing the movable magnetic armature to a separated rest position corresponding to the maximum air gap, and time delay means cooperating with the movable magnetic armature to perform chronometric selectivity of protection, wherein the time delay means comprise a damping device fitted on the movable magnetic armature and designed to be in an inactive state up to an intermediate non-tripping position when the movable magnetic armature is attracted by polar parts of the fixed magnetic armature during a first travel, switching to the active state resulting from a deformation of the damping device during a second travel of the movable armature between the intermediate position and the final attraction position causing tripping of the circuit breaker.

2. The trip unit according to claim 1, wherein the movable magnetic armature is mounted with pivoting on a bracket fixed to a conductor, and the damping device comprises a metallic blade of small thickness arranged in a gap between the movable armature and said bracket.

3. The trip unit according to claim 2, wherein the blade of the damping device comprises a base clipped onto a protuberance of the bracket and an upper part cooperating with a drive part of the movable magnetic armature.

4. The trip unit according to claim 3, wherein the drive part is formed by a band provided at the rear of the movable armature through which band said blade passes with clearance.

5. The trip unit according to claim 3, wherein the base of the blade presents a width slightly greater than the transverse distance separating the flanges of the bracket, said flanges acting as stop for the blade when the movable magnetic armature reaches the intermediate position during the first travel.

6. The trip unit according to claim 2, wherein the fixed bracket is equipped with lateral lugs arranged to define the rest position of the movable magnetic armature and said gap for housing the blade.

7. The trip unit according to claim 2, wherein the elastic return part of the movable armature is formed by a compression spring arranged on the side opposite the gap between the base of the bracket and an edge of the movable armature.

8. The trip unit according to claim 7, wherein the bracket, the blade of the damping device, the movable magnetic armature, and the compression spring constitute a pre-assembled sub-assembly fixed by a screw onto the conductor to form the selective magnetic trip device.

9. The trip unit according to claim 1, wherein the damping device comprises a compression spring securedly affixed to the movable magnetic armature and coming into engagement with the conductor at the end of the first travel of the armature.

10. The trip unit according to claim 1, wherein the damping device comprises a torsion spring mounted on the pivoting spindle of the movable magnetic armature.

* * * * *